US009482175B1

(12) United States Patent
Torgerud et al.

(10) Patent No.: US 9,482,175 B1
(45) Date of Patent: Nov. 1, 2016

(54) SYSTEMS AND METHODS FOR PROVIDING FUEL TO AN INTERNAL COMBUSTION ENGINE

(71) Applicant: Brunswick Corporation, Lake Forest, IL (US)

(72) Inventors: Michael A. Torgerud, Mt. Calvary, WI (US); Jason S. Arbuckle, Horicon, WI (US); Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 388 days.

(21) Appl. No.: 14/166,338

(22) Filed: Jan. 28, 2014

Related U.S. Application Data

(60) Provisional application No. 61/783,339, filed on Mar. 14, 2013.

(51) Int. Cl.
*F02M 37/04* (2006.01)
*F02D 41/30* (2006.01)

(52) U.S. Cl.
CPC ..... *F02D 41/3082* (2013.01)

(58) Field of Classification Search
CPC ..... F02D 41/2096; F02D 2041/2055; F02M 21/0245; F02M 37/04
USPC ..... 123/495, 497, 478, 480, 510, 500
See application file for complete search history.

(56) References Cited

U.S. PATENT DOCUMENTS

| | | | | |
|---|---|---|---|---|
| 4,034,730 | A * | 7/1977 | Ayres | F02D 41/3082 123/499 |
| 4,499,878 | A * | 2/1985 | Igashira | F02D 41/2096 123/478 |
| 4,836,157 | A * | 6/1989 | Miller | F02M 17/04 123/179.11 |
| 5,337,718 | A * | 8/1994 | Tuckey | F02D 41/3082 123/464 |
| 5,819,196 | A * | 10/1998 | Holmes | F02D 41/2464 701/103 |
| 6,253,742 | B1 | 7/2001 | Wickman et al. | |
| 6,390,871 | B1 | 5/2002 | Wickman et al. | |
| 6,857,917 | B1 | 2/2005 | Wasilewski | |
| 7,395,814 | B1 | 7/2008 | Doepke et al. | |
| 2011/0132328 | A1 * | 6/2011 | Attwood | F02M 37/0023 123/456 |

FOREIGN PATENT DOCUMENTS

WO 2008/065680 6/2008

* cited by examiner

*Primary Examiner* — John Kwon
(74) *Attorney, Agent, or Firm* — Andrus Intellectual Property Law, LLP

(57) ABSTRACT

A system for providing fuel to an internal combustion engine comprises a fuel reservoir for containing fuel for use by the internal combustion engine; a first pump that pumps fuel from a supply tank into the fuel reservoir; and a battery that provides electrical power to the first pump. A control circuit sends signals to selectively run the first pump so as both to minimize a total amount of electrical power consumed by the system and to maintain at least a minimum amount of fuel in the reservoir. Methods for filling a fuel reservoir that contains fuel for use by an internal combustion engine are also provided.

19 Claims, 4 Drawing Sheets

SYSTEMS AND METHODS FOR PROVIDING FUEL TO AN INTERNAL COMBUSTION ENGINE

CROSS-REFERENCE TO RELATED APPLICATION

This application claims the benefit of U.S. Provisional Application No. 61/783,339, filed Mar. 14, 2013, which is hereby incorporated by reference in entirety.

FIELD

The present disclosure relates to systems and methods for providing fuel to an internal combustion engine. For example, the systems and methods disclosed herein can be used to provide fuel to an internal combustion engine of a marine propulsion system.

BACKGROUND

Examples of prior art marine propulsion fuel systems are shown and described in U.S. Pat. Nos. 6,253,742 and 6,390,871, which are both hereby incorporated by reference in their entireties. Some marine propulsion systems, particularly outboard engines, have vented fuel supply modules (FSM), which require special accommodations to ensure that the FSM does not overfill and leak (overflow). These special accommodations may include a lift pump that is controlled by a powertrain control module (PCM) and a float switch within the FSM that controls the lift pump. In these systems, the PCM disables the lift pump when the float switch signals that the FSM is full. The PCM then tallies the amount of fuel consumed by the engine and turns the lift pump on once the total fuel consumed is above a calibrated threshold. The PCM will run the lift pump until the float switch signals that the FSM is full, at which point the PCM will disable the lift pump. The process will repeat during normal operation of the propulsion system. Other marine propulsion systems have unvented fuel supply modules in which the lift pump runs continuously to fill the FSM during normal operation of the propulsion system. Overfilling is usually not a problem for unvented FSMs, as there is no vent from which fluid can leak.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A system for providing fuel to an internal combustion engine is disclosed. The system comprises a fuel reservoir for containing fuel for use by the internal combustion engine and a first pump that pumps fuel from a supply tank into the fuel reservoir. A battery provides electrical power to the first pump. A control circuit sends signals to selectively run the first pump so as both to minimize a total amount of electrical power consumed by the system and to maintain at least a minimum amount of fuel in the reservoir.

An example of a method for filling a fuel reservoir that contains fuel for use by an internal combustion engine is also disclosed. The method comprises: (1) sending a control signal to run an electric pump for a first predetermined period of time so as to pump fuel from a supply tank into the fuel reservoir; (2) sending a control signal to stop the pump once the first predetermined period of time has elapsed; (3) calculating a running total amount of fuel provided to the internal combustion engine while the pump is stopped; and (4) sending a control signal to run the pump for a second predetermined period of time once the running total amount of fuel exceeds a predetermined threshold amount of fuel. The pump intermittently fills the fuel reservoir so as both to minimize a total amount of electrical power consumed by the pump and to maintain at least a minimum amount of fuel in the reservoir.

Another example of a method for filling a fuel reservoir that contains fuel for use by an internal combustion engine is disclosed. The method comprises the steps of: (1) sending a control signal to run an electric pump for a first predetermined period of time so as to pump fuel from a supply tank into the fuel reservoir; (2) sending a control signal to stop the pump once the first predetermined period of time has elapsed; (3) sending a control signal to start the internal combustion engine; (4) sending a control signal to run the pump for a second predetermined period of time; (5) sending a control signal to stop the pump once the second predetermined period of time has elapsed; (6) calculating an accumulated amount of fuel provided to the internal combustion engine while the pump is stopped; (7) sending a control signal to run the pump for a third predetermined period of time once the accumulated amount of fuel exceeds a predetermined threshold amount of fuel; (8) sending a control signal to stop the pump once the third predetermined period of time has elapsed; and (9) repeating steps (6), (7), and (8) for as long as the internal combustion engine is running.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
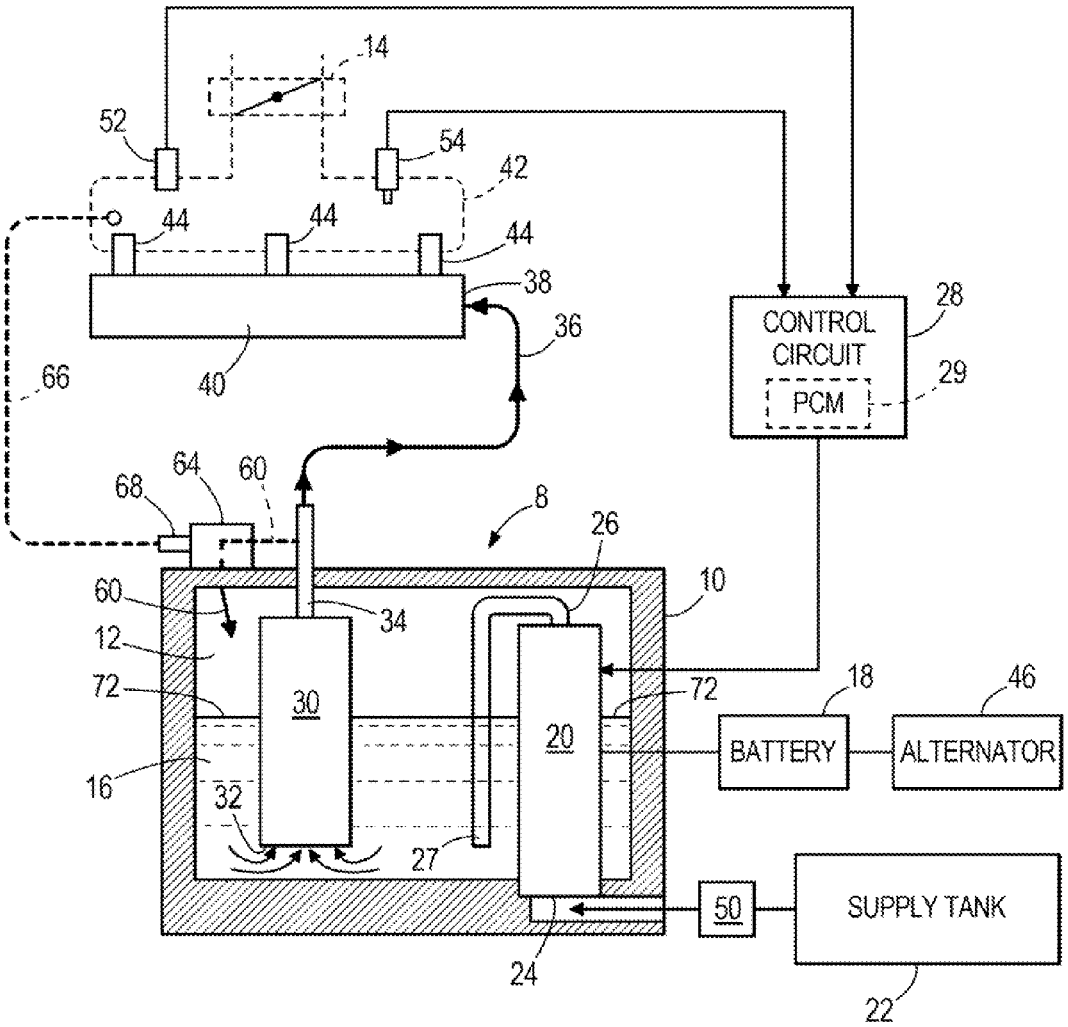
FIG. 1 is a schematic illustrating connections of various components of a fuel system for an internal combustion engine.

In FIG. 1, one example of a fuel system for an internal combustion engine is represented schematically. A fuel supply module (FSM) 8 comprises a fuel reservoir 10, a first pump 20 and a second pump 30. The fuel reservoir 10 encloses a cavity 12 for containing liquid fuel 16 for use by an internal combustion engine of, for example, a marine propulsion system. A first pump 20 is provided for drawing fuel from a fuel supply, such as a supply tank 22, and for pumping the fuel 16 at a first pressure magnitude into the cavity 12 of the fuel reservoir 10. The fuel 16 is drawn by the first pump 20 into its inlet 24 and pumped out of its outlet 26. In the embodiment shown in FIG. 1, a conduit 27 is provided to direct the fuel toward the bottom portion of the cavity 12.

The first pump 20 is controlled by a control circuit 28, which may comprise a powertrain control module (PCM) 29. The control circuit 28 includes a memory and a programmable processor. As is conventional, the processor can be communicatively connected to a computer readable medium that includes volatile or nonvolatile memory upon which computer readable code is stored. The processor can access the computer readable code on the computer readable medium, and upon executing the code can send signals to carry out functions according to the methods described herein below. Execution of the code allows the control circuit 28 to control a series of actuators on the internal combustion engine. The control circuit 28 may also read values from a multitude of sensors as described herein below, and interpret the data using look-up tables stored in the memory. The control circuit 28 can be connected to the devices (such as for example sensors and actuators) with which it communicates via wireless communication or by a serially wired CAN bus. It should be noted that the lines shown in FIG. 1 are meant to show only that various devices are capable of communicating with the control circuit 28, and do not necessarily represent actual wiring connecting the devices, nor do they represent the only paths of communication between the devices. Further, it should be understood that the control circuit 28 need not comprise a PCM 29, and that the control circuit 28 could additionally or alternatively comprise many different electronic control units at various locations aboard the marine vessel.

With reference back to the FSM 8, a second pump 30 is provided for drawing fuel 16 from the cavity 12 and pumping the fuel to the internal combustion engine. The second pump 30 is also connected to the control circuit 28, although such connection is not shown in FIG. 1. Although the entire internal combustion engine is not shown in FIG. 1, portions of the internal combustion engine such as a fuel rail 40 and an air intake manifold 42 are represented therein. The fuel rail 40 provides fuel to a plurality of fuel injectors 44, which inject fuel into the air intake manifold 42. The internal combustion engine may also comprise a throttle 14 that regulates airflow into the air intake manifold 42. A manifold pressure sensor 52 is provided for sensing pressure within the air intake manifold 42 and a temperature sensor 54 is provided for sensing temperature within the air intake manifold 42. These measured values are input to the control circuit 28, which uses them in an algorithm for controlling the first pump 20, as will be described further herein below.

Fuel is drawn into the inlet 32 of the second pump 30 and pumped out of the outlet 34, as represented by line 36 which can be a suitable conduit connected between the outlet 34 of the second pump 30 and an inlet 38 of the fuel rail 40. As can be seen in FIG. 1, both the first and second pumps, 20 and 30, are disposed within the cavity 12 of the fuel reservoir 10. In one example of the present disclosure, both the first and second pumps, 20 and 30, are electric pumps. This is not a required characteristic of the pumps 20, 30 in all alternative embodiments; however, in the example shown at least the first pump 20 is an electric pump. In one example, a battery 18 provides electrical power to the first pump 20. An alternator 46 driven by a crankshaft (not shown) of the internal combustion engine re-charges the battery 18 as power is consumed by the first pump 20. In another example, the second pump 30 is also powered by the battery 18, although such connection is not shown in FIG. 1.

With continued reference to FIG. 1, it can be seen that the supply tank 22 is connected, as a fuel supply, to the inlet 24 of the first pump 20. A fuel filter 50 is shown connected in fluid communication between the supply tank 22 and the first pump 20. In one example, this fuel filter 50 is a water-separating fuel filter.

The fuel rail 40 is connected in fluid communication with the outlet 34 of the second pump 30 and also in fluid communication with the plurality of fuel injectors 44, as illustrated schematically in FIG. 1. A pressure regulator 64 regulates the pressure at which the second pump 30 provides fuel to the fuel rail 40. Dashed line 66 represents a connection between the air intake manifold 42 and a reference pressure inlet 68 of the pressure regulator 64. In order to maintain a pressure within the fuel rail 40 that is a preselected magnitude greater than the pressure in line 66, a return line 60 is provided at the outlet 34 of the second pump 30 for relieving excess pressure by allowing fuel to flow back into the cavity 12.

A level of fuel 16 within the fuel reservoir 10 is represented by the line 72. The present disclosure includes systems and methods that are designed to selectively run the first pump 20 so as to both minimize a total amount of electrical power consumed by the system and so as to maintain at least a minimum amount of fuel 16 in the fuel reservoir 10, as indicated by line 72. The control circuit 28 ensures that at least the minimum amount of fuel is in the fuel reservoir 10 by selectively running the first pump 20 based on a running total amount of fuel provided to the internal combustion engine, as will be described further herein below.

In the example shown, the first pump 20 is a lift pump that pumps a high volume of fuel at a low pressure, and the second pump 30 is a high-pressure, low-volume pump. Further, the FSM 8 shown in FIG. 1 is unvented. This means that traditionally the lift pump (first pump 20) would run continuously to fill the fuel reservoir 10 because overfilling is not a problem for unvented FSMs. However, through research and development, the present inventors have realized that running the first pump 20 continuously can have detrimental effects on the first pump 20 and on a marine propulsion system as a whole because doing so draws excess current from the battery 18. For example, a continuously running FSM 8 consumes approximately three amps while running, which adds an undesirable electrical load to the electrical system. The addition of power steering, fuel injection, electronic steering, helm display devices, joysticks, and navigation systems have placed a large load on the electrical system of a marine vessel. These electrical loads have reduced the available charging current from the alternator 46 which can lead to insufficient charging of the battery 18 particularly at idle, when the speed of the internal combustion engine is low and therefore the alternator 46 is not producing much current. Insufficient charging of the battery 18 can, in turn, lead to hard starting or non-starting engines. Therefore, the present inventors realized the importance of reducing current draw where possible, and especially near idle speeds when available charging current from the alternator 46 is typically at its lowest.

It may be desirable for a marine propulsion system to have a net charging current greater than, for example, twenty amps at idle speed. A larger alternator 46 or a faster spinning alternator 46 can accomplish this goal but does so at a significant cost increase and a decrease in component durability. Alternatively, the present inventors have realized that control of electrical loads can help to increase the available charging current without the expense increase or durability issues associated with modifications to the alternator 46.

Figure 2:
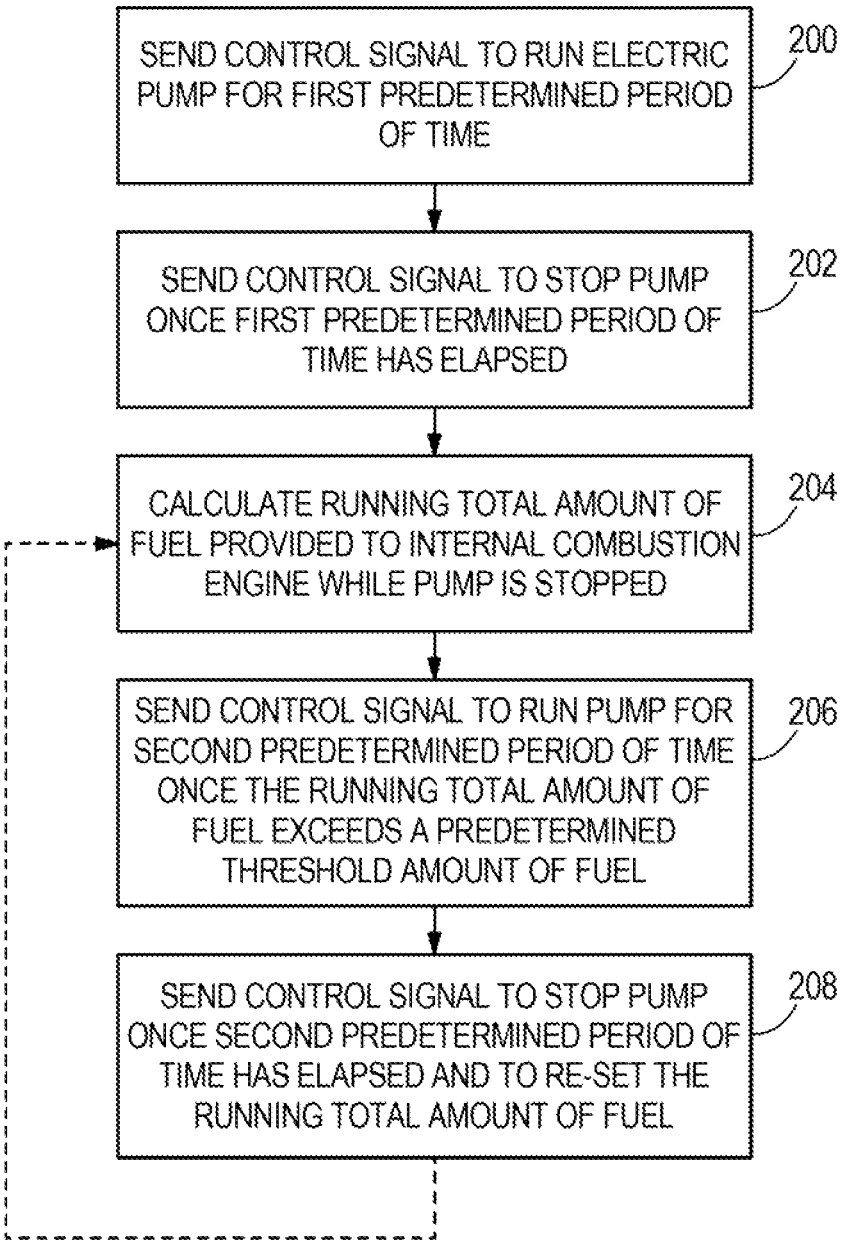
FIG. 2 illustrates an example of a method for filling fuel reservoir that contains fuel for use by the internal combustion engine.

Now with reference to FIG. 2, one method for filling the fuel reservoir 10 that contains fuel for use by the internal combustion engine will be described. According to the method, an electric pump, such as first pump 20, intermittently fills the fuel reservoir 10 so as both to minimize a total amount of electrical power consumed by the first pump 20 and to maintain at least a minimum amount of fuel in the fuel reservoir 10. As shown at box 200, the method may comprise sending a control signal to run the electric first pump 20 for a first predetermined period of time so as to pump fuel from the supply tank 22 into the fuel reservoir 10. The method next comprises sending a control signal to stop the first pump 20 once the first predetermined period of time has elapsed, as shown at box 202. In one example, the first predetermined period of time is ten minutes.

The method may further comprise calculating a running total amount of fuel provided to the internal combustion engine while the first pump 20 is stopped, as shown at box 204. Example calculations for calculating the running total amount of fuel are described herein below. As shown at box 206, the method may further comprise sending a control signal to run the first pump 20 for a second predetermined period of time once the running total amount of fuel exceeds a predetermined threshold amount of fuel. For example, the second predetermined period of time may be twenty seconds. In one example, as shown at box 208, the method may further comprise sending a control signal to stop the first pump 20 once the second predetermined period of time has elapsed and to re-set the running total amount of fuel. The method may then further comprise repeating the steps shown in boxes 204, 206, and 208 for as long as the internal combustion engine is running.

Figure 3:
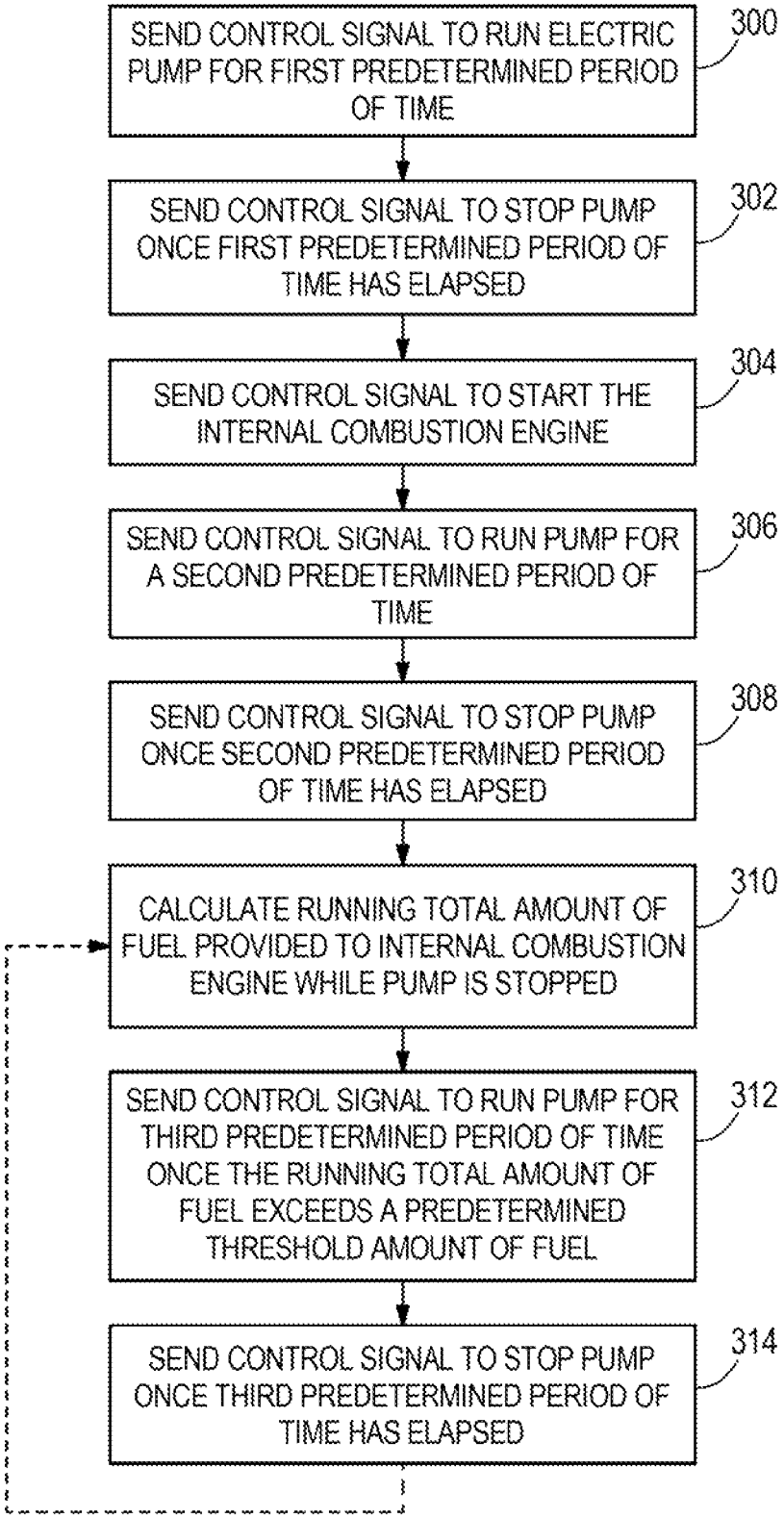
FIG. 3 illustrates another example of a method for filling a fuel reservoir that contains fuel for use by an internal combustion engine.

Now with reference to FIG. 3, another example of a method for filling a fuel reservoir 10 of the internal combustion engine may comprise the following steps. The method may comprise sending a control signal to run an electric pump, such as first pump 20, for a first predetermined period of time, as shown at box 300. The method may further comprise sending a control signal to stop first pump 20 once the first predetermined period of time has elapsed, as shown at box 302. In one example, the first predetermined period of time is ten seconds. These steps prime the first pump 20.

The method may further comprise sending a control signal to start the internal combustion engine, as shown at box 304. The method may then comprise sending a control signal to run the first pump 20 for a second predetermined period of time. For example, the second predetermined period of time may be ten minutes. As shown at box 308, the method may further comprise sending a control signal to stop the first pump 20 once the second predetermined period of time has elapsed. Running the first pump 20 for the second predetermined period of time ensures that the fuel reservoir 10 is full before running the internal combustion engine and carrying out the rest of the method described herein. Filling the fuel reservoir 10 provides enough fuel to run the internal combustion engine at idle for several minutes.

The method may then comprise calculating a running total amount of fuel provided to the internal combustion engine while the first pump 20 is stopped, as shown at box 310. This calculation may be performed as described herein below or in any other way known to those of skill in the art. The method may further comprise sending a control signal to run the first pump 20 for a third predetermined period of time once the running total amount of fuel exceeds a predetermined threshold amount of fuel, as shown at box 312. The method may then comprise sending a control signal to stop the first pump 20 once the third predetermined period of time has elapsed, as shown at box 314. In one example, the third predetermined period of time is twenty seconds.

The method may then comprise repeating the steps shown in boxes 310 to 314 for as long as the internal combustion engine is running. The method may further comprise sending a control signal to stop first pump 20 when the internal combustion engine is not running. Further, the method may comprise resetting the running total amount of fuel after the step in box 314 and before repeating the step in box 310.

Figure 4:
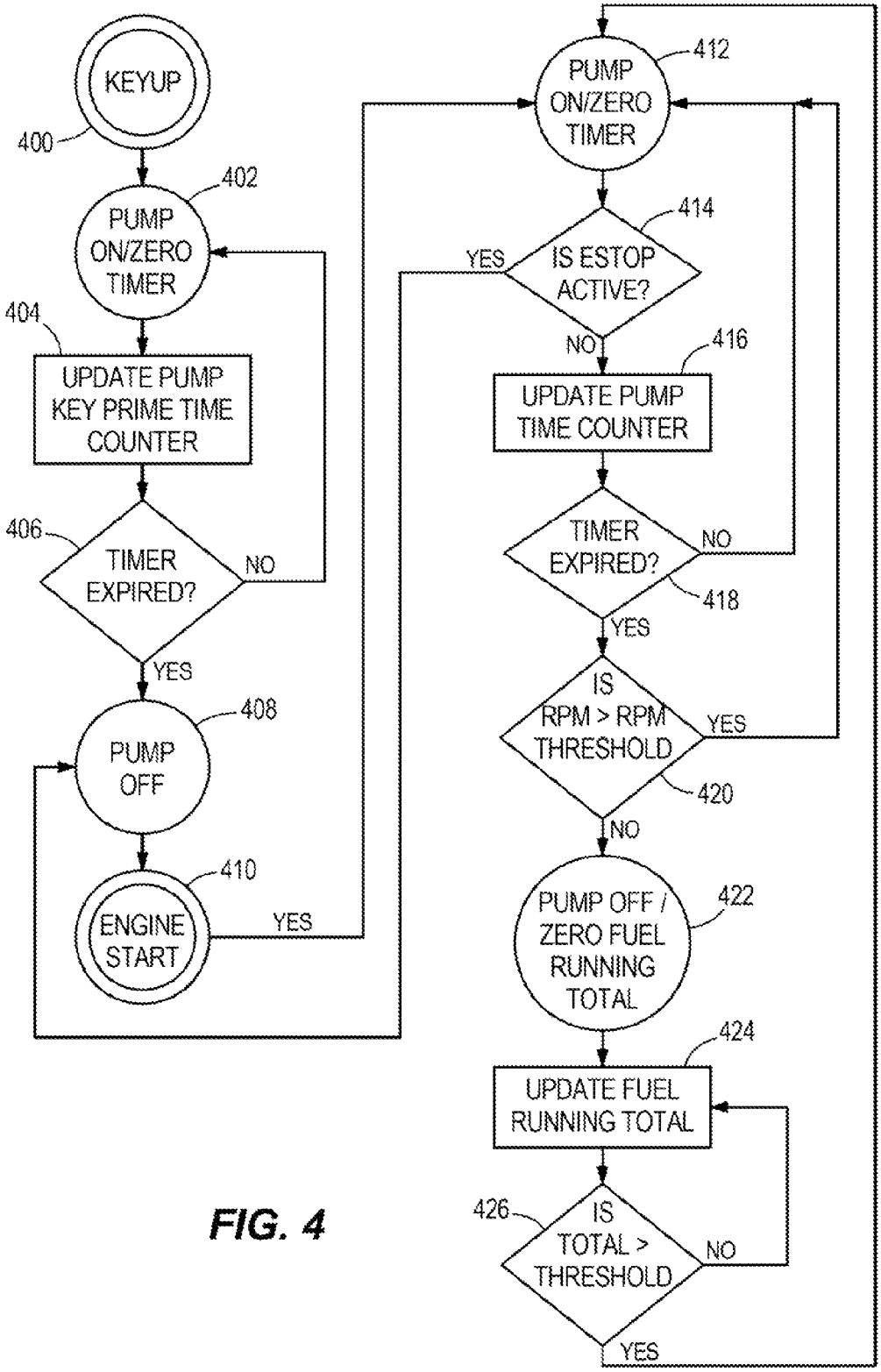
FIG. 4 illustrates yet another example of a method for filling a fuel reservoir that contains fuel for use by an internal combustion engine.

Now with reference to FIG. 4, an algorithm for programming the control circuit 28 is shown. As shown at 400, the control circuit 28 receives a user input that the engine has been keyed-up. The control circuit 28 then sends a signal at 402 to turn on the first pump 20 for a period of time in order to prime the first pump 20, while updating the pump key prime time counter, as shown at 404. At 406, the control circuit 28 determines whether the key-up timer has expired. If no, the logic returns to 402 and the pump key prime time counter continues to update while the first pump 20 remains on. If, however, the key-up timer has expired at 406, the logic moves to 408 and the control circuit sends a signal to turn the first pump 20 off. As shown at 410, if the control circuit 28 receives a user input to start the internal combustion engine, the control circuit 28 then sends a signal to turn the first pump 20 on and to zero a pump time counter, as shown at 412.

Next, at 414, a determination is made as to whether the emergency stop is active. If yes, the logic returns to 408, and the control circuit 28 sends a signal to turn the first pump 20 off. If no, the pump time counter is updated, as shown at 416. A determination is then made at 418 as to whether the pump time counter has expired. If no, the first pump 20 remains on, a determination is again made at 414 as to whether the emergency stop is active, and if not, the pump time counter is again updated at 416. The logic of 412, 414, 416, and 418 is repeated until the first pump 20 has filled the fuel reservoir 10.

Once the pump time counter has expired as determined at 418, the control circuit 28 determines whether the current engine speed is greater than an engine speed threshold stored in its memory, as shown at 420. (In another example, the determination at 420 is whether a fueling rate is greater than a fueling rate threshold.) If yes at 420, the logic returns to 412 where the pump remains on. If no, the logic moves to 422, where the control circuit 28 sends a signal to turn off the first pump 20 and to zero a previously-stored fuel running total. After the first pump 20 has been turned off and the previously-stored fuel running total has been zeroed, the control circuit 28 updates the current fuel running total, as shown at 424. The control circuit 28 then determines at 426 whether the fuel running total is greater than a threshold amount of fuel. If no, the control circuit 28 continues to update the fuel running total as long as the internal combustion engine is running. If the fuel running total is greater than a threshold amount of fuel, the logic returns to 412, and the control circuit 28 sends a signal to turn on the first pump 20 and to zero the timer.

The control circuit 28 can calculate the running total amount of fuel provided to the internal combustion engine in a number of different ways. In one example, the control circuit 28 determines the running total amount of fuel based on the speed of the internal combustion engine. In this example, the running total amount of fuel provided to the internal combustion engine is calculated by integrating a mass flow rate of fuel provided to the internal combustion engine. Such calculations require input of a number of measured values, such as intake manifold pressure (measured by manifold pressure sensor 52), barometric pressure (measured by the manifold pressure sensor 52 at key-up of the engine), intake manifold temperature (measured by temperature sensor 54), and speed of the engine (measured by an engine speed sensor, not shown). Further, the memory of the control circuit 28 may store several values such as cylinder swept volume, number of combustion events per revolution of engine, standard temperature, volumetric efficiency of the engine, and air-fuel ratio of the fuel being used. Given each of these values and the measured values indicated above, the control circuit 28 can calculate a desired equivalence ratio (ratio of fuel to air). Then, software stored in the control circuit 28 can apply the ideal gas law (PV=nRT) to calculate the mass flow of fuel into the engine. This flow rate can then be further modified by programming of the control circuit 28 with per cylinder multipliers, oxygen fuel multipliers, knock multipliers, and/or transient fueling values. The output of such calculation is a per-cylinder fuel flow rate. If the individual fuel flow rate per cylinder is summed across the cylinders, for example once every second, the total fuel provided to the internal combustion engine can then be determined.

In another example, the running total amount of fuel provided to the internal combustion engine is calculated using known pulse widths of the plurality of fuel injectors 44 and the injection pressures of the plurality of fuel injectors 44.

It should be understood that there are a number of ways the control circuit 28 can determine whether the fuel reservoir 10 needs to be refilled in order to maintain at least a minimum amount of fuel in the fuel reservoir 10, of which two examples will now be described. In one example, the fuel reservoir 10 is refilled when the control circuit 28 determines that the predetermined threshold amount of fuel has been consumed. In this first example, the control circuit 28 sends a signal to run the first pump 20 for a predetermined period of time once the running total amount of fuel exceeds a predetermined threshold amount of fuel that has been stored in the memory of the control circuit 28. In another example, the fuel reservoir is refilled when the control circuit 28 determines that the fuel 16 in the fuel reservoir 10 has fallen below a minimum amount that has been stored in the memory of the control circuit 28. In this second example, the control circuit 28 sends a control signal to the first pump 20 to fill the fuel reservoir 10 to a known amount. This known amount is stored in the memory of the control circuit 28. The processor may then continuously subtract the running total amount of fuel from the stored known amount to determine a remaining amount of fuel in the fuel reservoir 10. The control circuit 28 then sends a control signal to run the first pump 20 for a predetermined period of time once the remaining amount of fuel falls below the minimum amount of fuel that has been stored in the memory. It should be understood that these two methods are not the only way to determine that the fuel reservoir 10 needs to be refilled, and therefore are not limiting on the scope of the present claims.

In some examples, the minimum amount of fuel that is stored in the memory of the control circuit 28 is predetermined based on one or more operating conditions of the internal combustion engine. For example, the minimum amount of fuel may depend on engine temperature, engine speed, or engine load. For example, the minimum amount of fuel may increase with engine speed in order to accommodate increased fueling needs. The minimum amount of fuel for a given operating condition of the internal combustion engine can be stored in the memory of the control circuit 28 during calibration.

The methods described above may be used throughout all speed ranges of the internal combustion engine to reduce the amount of electrical power consumed by the first pump 20 independently of the speed of the internal combustion engine. Alternatively, the methods described above can be used to intermittently fill the fuel reservoir 10 by intermittently running the first pump 20 only in a lower range of engine speeds. For example, each method may additionally comprise sending control signals to selectively run the first pump 20 when the internal combustion engine is operating at a speed that is below a predetermined threshold speed, and to continuously run the first pump 20 when the internal combustion engine is operating at a speed that is above the predetermined threshold speed. (See, for example, the determination at 420 in FIG. 4.) In this way, the amount of time that the battery 18 provides power to the first pump 20 is regulated only at lower engine speeds, such as when the internal combustion engine is idling and available charging current from the alternator 46 is less. In one example, the predetermined threshold speed is 2,000 RPM.

In other examples of the methods described hereinabove, the control circuit 28 sends a signal to disable the first pump 20 when the internal combustion engine is not running, such as, for example, when it is stalled or an emergency stop has been activated. The methods described enhance safety by causing the internal combustion engine to run out of fuel if there is a significant fuel leak in the system.

Other benefits of intermittently running the first pump 20 include the following: decreased pump wear and extended pump life as a result of less run time; decreased wear of pump motor brushes, resulting in less brush particulate contamination circulating within the fuel system; less contaminant, resulting in less plugging of screens at fuel injectors, filters, and regulators; less noise during extended periods of low speed running of the internal combustion engine; and improved hot fuel handling performance immediately following extended periods of low speed internal combustion engine operation.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and methods described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. A system for providing fuel to an internal combustion engine, the system comprising:

a fuel reservoir for containing fuel for use by the internal combustion engine;

a first pump that pumps fuel from a supply tank into the fuel reservoir;

a battery that provides electrical power to the first pump; and a control circuit that sends signals to selectively run the first pump so as both to minimize a total amount of electrical power consumed by the system and to maintain at least a minimum amount of fuel in the fuel reservoir;

wherein the control circuit selectively runs the first pump in response to the internal combustion engine operating at a speed that is below a predetermined threshold speed, and continuously runs the first pump in response to the internal combustion engine operating at a speed that is above the predetermined threshold speed.

2. The system of claim 1, further comprising a second pump that pumps fuel from the fuel reservoir to a fuel rail having a plurality of fuel injectors that inject fuel into the internal combustion engine.

3. The system of claim 2, wherein the control circuit sends signals to selectively run the first pump based on a running total amount of fuel provided to the internal combustion engine.

4. The system of claim 3, wherein the control circuit sends a signal to run the first pump for a predetermined period of time once the running total amount of fuel exceeds a predetermined threshold amount of fuel.

5. The system of claim 3, wherein the control circuit determines the running total amount of fuel based on the speed of the internal combustion engine.

6. The system of claim 3, wherein the control circuit determines the running total amount of fuel based on known pulse widths and injection pressures of the plurality of fuel injectors.

7. The system of claim 3, wherein the first pump fills the fuel reservoir to a known amount, the control circuit continuously subtracts the running total amount of fuel from the known amount to determine a remaining amount of fuel in the fuel reservoir, and the control circuit sends a signal to run the first pump for a predetermined period of time once the remaining amount of fuel falls below the minimum amount of fuel in the fuel reservoir.

8. The system of claim 1, wherein the first pump is a lift pump.

9. The system of claim 2, wherein the second pump is a high-pressure pump.

10. A method for filling a fuel reservoir that contains fuel for use by an internal combustion engine, the method comprising the steps of:

(1) sending a control signal to run an electric pump for a first predetermined period of time so as to pump fuel from a supply tank into the fuel reservoir;

(2) sending a control signal to stop the pump once the first predetermined period of time has elapsed;

(3) calculating a running total amount of fuel provided to the internal combustion engine while the pump is stopped; and (4) sending a control signal to run the pump for a second predetermined period of time once the running total amount of fuel exceeds a predetermined threshold amount of fuel;

wherein the pump intermittently fills the fuel reservoir so as both to minimize a total amount of electrical power consumed by the pump and to maintain at least a minimum amount of fuel in the fuel reservoir.

11. The method of claim 10, further comprising sending control signals to selectively run the pump when the internal combustion engine is operating at a speed that is below a predetermined threshold speed, and to continuously run the pump when the internal combustion engine is operating at a speed that is above the predetermined threshold speed.

12. The method of claim 10, further comprising calculating the running total amount of fuel provided to the internal combustion engine by integrating a mass flow rate of fuel provided to the internal combustion engine.

13. The method of claim 10, further comprising calculating the running total amount of fuel provided to the internal combustion engine using known pulse widths and injection pressures of a plurality of fuel injectors that provide fuel to the internal combustion engine.

14. The method of claim 10, further comprising sending a control signal to fill the fuel reservoir to a known amount, continuously subtracting the running total amount of fuel from the known amount to determine a remaining amount of fuel in the fuel reservoir, and sending a control signal to run the pump for the second predetermined period of time once the remaining amount of fuel falls below the minimum amount of fuel in the fuel reservoir.

15. The method of claim 10, further comprising the step of:

(5) sending a control signal to stop the pump once the second predetermined period of time has elapsed and to re-set the running total amount of fuel.

16. The method of claim 15, further comprising repeating steps (3), (4), and (5) for as long as the internal combustion engine is running.

17. The method of claim 10, further comprising sending a control signal to stop the pump when the internal combustion engine is not running.

18. The method of claim 10, wherein the minimum amount of fuel in the fuel reservoir is predetermined based on one or more operating conditions of the internal combustion engine.

19. A method for filling a fuel reservoir that contains fuel for use by an internal combustion engine, the method comprising the steps of:

(1) sending a control signal to run an electric pump for a first predetermined period of time so as to pump fuel from a supply tank into the fuel reservoir;

(2) sending a control signal to stop the pump once the first predetermined period of time has elapsed;

(3) sending a control signal to start the internal combustion engine;

(4) sending a control signal to run the pump for a second predetermined period of time;

(5) sending a control signal to stop the pump once the second predetermined period of time has elapsed;

(6) calculating a running total amount of fuel provided to the internal combustion engine while the pump is stopped;

(7) sending a control signal to run the pump for a third predetermined period of time once the running total amount of fuel exceeds a predetermined threshold amount of fuel;

(8) sending a control signal to stop the pump once the third predetermined period of time has elapsed; and (9) repeating steps (6), (7), and (8) for as long as the internal combustion engine is running.

* * * * *